United States Patent [19]

Maxwell

[11] 3,941,488

[45] Mar. 2, 1976

[54] MARKER/ANTI-MARKER SYSTEM

[76] Inventor: David Maxwell, 6035 Broadway, New York, N.Y. 10471

[22] Filed: July 10, 1974

[21] Appl. No.: 487,292

[52] U.S. Cl. ..... 401/17; 401/199; 401/213

[51] Int. Cl. ..... B43k 27/10; B43k 5/00

[58] Field of Search ..... 401/17, 18, 34, 198, 199, 401/195, 213

[56] References Cited

UNITED STATES PATENTS

| | | | |
|---|---|---|---|
| 1,508,090 | 9/1924 | Detrick | 401/17 |
| 2,571,620 | 10/1951 | Sala | 401/34 X |

FOREIGN PATENTS OR APPLICATIONS

| | | | |
|---|---|---|---|
| 978,585 | 11/1950 | France | 401/17 |
| 1,418,087 | 10/1965 | France | 401/199 |
| 431,521 | 7/1926 | Germany | 401/34 |

*Primary Examiner*—Lawrence Charles
*Attorney, Agent, or Firm*—Kane, Dalsimer, Kane, Sullivan and Kurucz

[57] ABSTRACT

A marker system that employs an erasing unit that can couple and uncouple readily from its marker to facilitate the use of specific chemical reagents to "erase" their associated indicator dye inks without the use of non-discriminating bleaches. This erasing unit or anti-marker marker can be mounted in the marker cap, alternately in the marker barrel or used as a separate erasing unit.

1 Claim, 13 Drawing Figures

MARKER/ANTI-MARKER SYSTEM

SUMMARY OF THE INVENTION

This invention relates to a complete marker system that employs a marker, its cap and a separate erasing unit with indicator dyes/reagent chemicals to accomplish marking and erasure in a convenient manner.

The inks used for the marker would be of a wide range of chemicals known as indicator dyes dissolved or combined in suitable chemical vehicles to bring out their individual characteristic colors. The erasing fluid would be the specific chemical reagent that would react with the indicator dyes to return them to their neutral colorless condition.

The indicator dyes would be used to impregnate a wick of glass wool or other suitable material and dispensed through a porous tip the whole enclosed in a hollow tube. The erasing unit, or anti-marker marker, would be similar in construction to the marker except that the wick would be impregnated with the erasing reagent.

In the preferred arrangement the marker cap would act as the connecting device for the marker and the erasing unit. They would both be mounted in the cap at opposite ends with a plastic diaphragm to prevent any premature co-mingling of the chemicals when both tip ends are inserted in the cap. Both marker and erasing unit can be reversed in the cap as usage dictates.

In an alternate arrangement the erasing unit would fit into the marker tube opposite the porous tip end with a plastic diaphragm interposed to prevent premature co-mingling of the chemicals. The erasing unit could be positioned point up or down as usage would dictate. No separate cap for the erasing unit would be necessary since in this arrangement the marker barrel itself would in effect act as a protective cap.

In both arrangements a marker cap, with an optional clip, would be necessary to protect the marker from evaporation of the chemical fluids.

The erasing unit could be furnished as a completely separate entity or as a refill for the original erasing unit if it should be exhausted or if the chemical reagent has been allowed to evaporate.

Other objects and advantages of the invention will become apparent from the following detailed description of the invention which is to be taken in conjunction with the accompanying drawings illustrating preferred embodiments of the invention, as well as an alternate arrangement and refill capabilities of the erasing unit.

DESCRIPTION OF THE SYSTEM

Figures 1, 2, 3, 4, 5, 6, 7, 8, 9A, 9B, 9C, 9D, 9E:
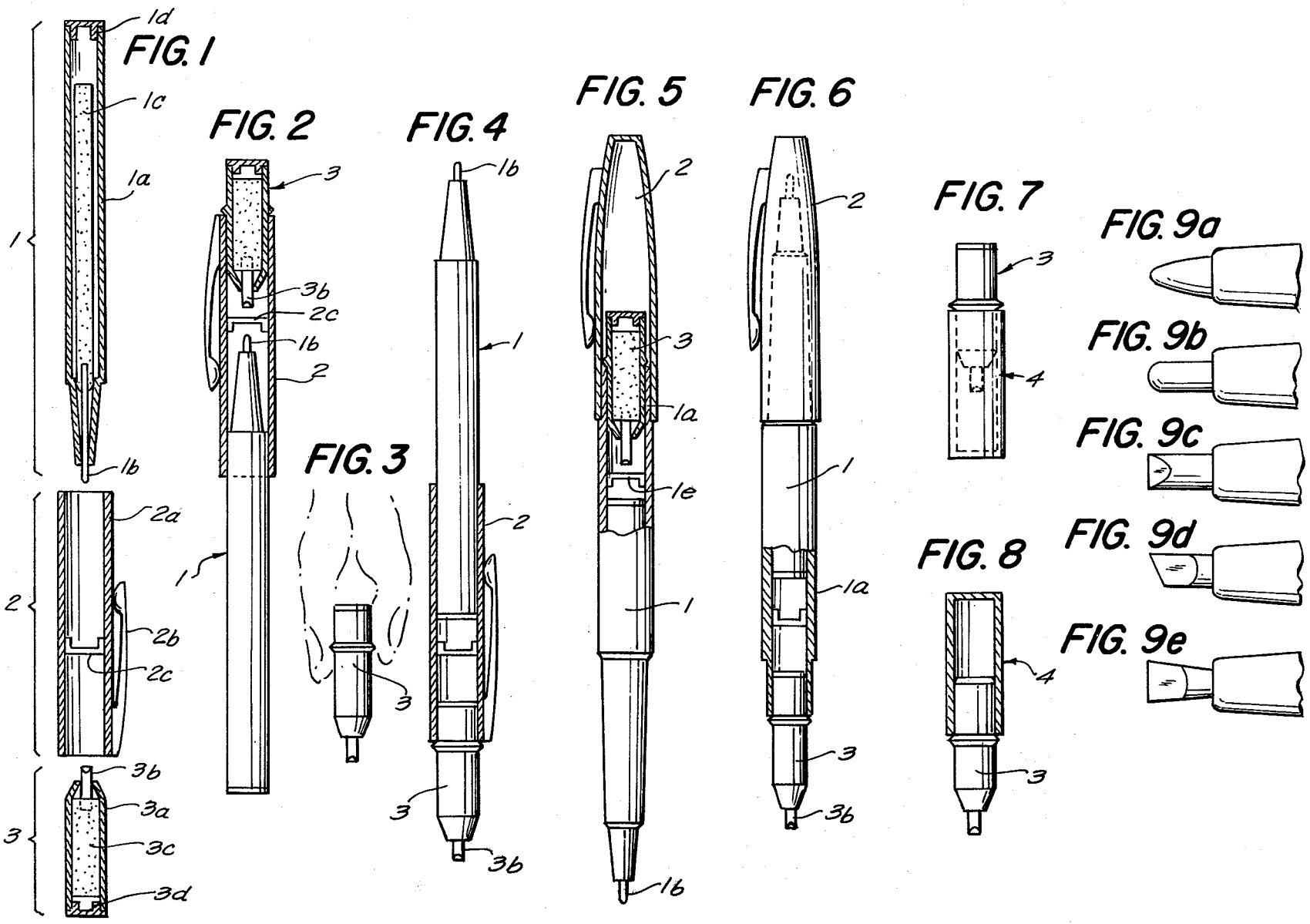
FIG. 1 is an exploded view showing the basic components of the marker/anti-marker marker system of the present invention including a marker, a cap therefor and a separate compatible erasing unit in sectional detail.
FIG. 2 is a side view of the system showing the marker, the cap and eraser unit in section with both the writing tip and the eraser tip inserted into the cap.
FIG. 3 is a view of the eraser unit used outside of the marker and held by the fingers.
FIG. 4 is a view of the system of FIG. 2 with the marker barrel and eraser unit barrel inserted into the cap and the writing and eraser tips in position for use.
FIG. 5 is a side view of an alternate form of the system with the eraser unit and tip inserted into the back end of the marker barrel and the cap covering the eraser unit barrel, both barrels being in section.
FIG. 6 is a view of the marker assembly of FIG. 5 with the marker barrel covering the writing tip and the eraser unit tip projecting from the back end of the marker barrel in position for use.
FIG. 7 is a view of the eraser unit with the tip covered with a cap.
FIG. 8 is a view of the eraser unit and cap of FIG. 7 with the tip projecting from the cap in position for use.
FIGS. 9*a* through 9*e* inclusive illustrate various forms of eraser tips.

In FIG. 1 the complete marker unit assembly is designated as 1. The details are: the marker barrel 1*a;* porous tip 1*b;* a wick 1*c* of glass wool or other suitable material impregnated with an indicator dye in a suitable vehicle as the marker ink; the end plug 1*d* cemented in position. The complete cap assembly is designated as 2. The details are: the cap barrel 2*a;* the optional clip 2*b;* the plastic diaphragm 2*c* to keep chemicals from the marker tip 1*b* and the erasing unit tip 3*b* from co-mingling when both are inserted into the cap 2. The erasing unit complete assembly is designated as 3. Details are: the enclosing barrel 3*a;* the porous dispensing tip 3*b;* the wick 3*c* of glass wool or other suitable material impregnated with the corresponding reagent to react with the indicator dye to turn it into its colorless mode; the end cap 3*d* cemented in place to close up the barrel 3*a*.

The preferred embodiment of these components is shown in FIGS. 2, 3 and 4. In FIG. 3 the aforementioned components are assembled to protect the porous tip 1*b* of the marker 1 and the porous tip 3*b* of the erasing unit 3 in a fashion to protect them and their associated chemicals from evaporation. FIG. 3 shows the erasing unit 3 removed from the assembly and held in the fingers ready to erase. FIG. 4 shows the marker unit 1 with the porous tip 1*b* exposed for writing and inserted into the cap 2 with the porous tip 3*b* exposed for erasing. After erasure, the erasing unit 3 can be immediately reversed and inserted into the cap 2 for protection from undue evaporation of the contents.

An alternate arrangement of components 1, 2 and 3 is shown in FIGS. 5 and 6. In FIG. 5 the erasing unit is positioned in the end of the marker barrel 1*a* opposite the tip end 1*b*. In effect the marker barrel 1*a* is the cap for the erasing unit 3. Note insertion of plastic diaphragm 1*e* in the marker barrel 1*a* to keep chemicals from inadvertantly co-mingling. The cap 2 is only open at one end and does not need a separator diaphragm in this arrangement. FIG. 6 shows the erasing unit 3 reversed in the marker barrel 1*a* to expose the erasing tip 3*b*.

FIG. 7 shows the erasing unit 3 in a separate cap 4 which can be used as an individual entity or as a refull for either arrangement previously mentioned.

FIG. 8 shows how the cap 4 can be used to extend the length of erasing unit 3 if desired.

FIGS. 9*a* – 9*e* illustrate various forms of eraser tips which can be used with the pen of the present invention, as follows:

9*a* — point
9*b* — ball

*9c* — chisel
*9d* — angle
*9e* — flare

Obviously, those skilled in the art with the foregoing disclosure in mind can derive many indicator/reagent coupling systems. Examples of such systems might be thymolphthalein (blue) or phenolphtholein (red) dissolved in a suitable alkaline vehicle as the marking liquid; and the eraser or anti-marking liquid could be such reagents as citric acid or acetic acid. In this manner, the system of the present invention need not resort to non-discriminating bleaches such as sodium hypochlorite which not only bleaches many inks but any color present in the writing paper or clothing and furnishings if accidently dropped thereon.

Thus, among others, the several aforenoted objects and advantages are most effectively attained. Although several somewhat preferred and alternate embodiments of the invention have been disclosed and described in detail herein, it should be understood that this invention is in no sense limited thereby and its scope is to be determined by that of the appended claims.

I claim:

1. An indicator/reagent coupled marking system comprising:

a marker having a barrel containing a marking liquid, a writing tip at one end of the marker barrel and means to feed the marking liquid from the said barrel to the said tip;

an eraser coupled with the marker having a barrel containing a liquid capable of erasing marks made by the said marking liquid, an erasing tip at one end of the eraser barrel and means to feed the erasing liquid from the said eraser barrel to the said eraser tip;

a unitary one-piece cap and support means for both the marker and the eraser, the cap and support means being open at both ends and hollow, one end being adapted to receive either end of the marker and the other end adapted to receive either end of the eraser whereby the tips can be inserted into the cap and support means for protection or exposed for use and the cap and support means adapted to support both the marker and eraser simultaneously as a unitary one-piece structure whether one or both of the marker and eraser are capped or exposed for use; and a diaphragm sealingly positioned in the cap and support means intermediate the ends thereof to separate one end portion from the other end portion and thereby preventing communication between the portion of the cap and support means containing the marker and the portion of the cap and support means containing the eraser.

* * * * *